US006478351B1

(12) United States Patent
Nelson

(10) Patent No.: US 6,478,351 B1
(45) Date of Patent: Nov. 12, 2002

(54) PET REFUSE COLLECTING SYSTEM

(76) Inventor: Troy L. Nelson, 3871 N. 25th St., Milwaukee, WI (US) 53206

( * ) Notice: Subject to any disclaimer, the term of this patent is extended or adjusted under 35 U.S.C. 154(b) by 0 days.

(21) Appl. No.: 09/881,879

(22) Filed: Jun. 15, 2001

(51) Int. Cl.[7] ..... A01K 29/00; E01H 1/12

(52) U.S. Cl. ..... 294/1.4; 294/55; 15/257.2; 15/257.7

(58) Field of Search ..... 294/1.3, 1.4, 1.5, 294/51, 55, 59; 15/257.1, 257.2, 257.3, 257.4, 257.6, 257.7, 104.8; 403/377

(56) References Cited

U.S. PATENT DOCUMENTS

| | | | | | |
|---|---|---|---|---|---|
| 3,827,098 | A | * | 8/1974 | Sanderson | 15/104.8 |
| 4,179,145 | A | | 12/1979 | Shinsako | |
| 4,222,597 | A | * | 9/1980 | Willis | 294/1.4 |
| 4,279,437 | A | | 7/1981 | Goldbarg | |
| D263,512 | S | | 3/1982 | Kavada | |
| 4,368,907 | A | * | 1/1983 | Ross | 294/1.4 |
| 4,447,082 | A | * | 5/1984 | Lindholm | 294/1.4 |
| D285,012 | S | * | 8/1986 | Willis | 294/1.4 |
| 4,741,566 | A | * | 5/1988 | Byung-Do et al. | 15/104.8 |
| 4,802,702 | A | * | 2/1989 | Bownds | 294/19.1 |
| D333,888 | S | * | 3/1993 | Visser | 294/1.4 |
| 5,540,470 | A | | 7/1996 | Lu | |
| 5,671,959 | A | | 9/1997 | Tsou | |
| 5,899,510 | A | | 5/1999 | Hayes et al. | |
| 6,019,405 | A | | 2/2000 | Tsou | |
| 6,052,860 | A | * | 4/2000 | Coxsey | 141/316 |

* cited by examiner

*Primary Examiner*—Dean J. Kramer

(57) ABSTRACT

A pet refuse collecting system for more easily collecting pet refuse. The pet refuse collecting system includes a housing for collecting and storing the pet refuse. An end of the housing includes an opening extending into an interior of the housing. An end of a handle is mounted on the housing for transporting the housing. A gathering assembly is provided for facilitating movement of pet refuse into the interior of the housing.

18 Claims, 3 Drawing Sheets

PET REFUSE COLLECTING SYSTEM

BACKGROUND OF THE INVENTION

1. Field of the Invention

The present invention relates to pet refuse scooping devices and more particularly pertains to a new pet refuse collecting system for more easily and more sanitarily collecting pet refuse.

2. Description of the Prior Art

The use of pet refuse scooping devices is known in the prior art. More specifically, pet refuse scooping devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,179,145; U.S. Pat. No. 5,540,470; U.S. Pat. No. 6,019,405; U.S. Pat. No. 5,899,510; U.S. Pat. No. 5,671,959; U.S. Pat. No. 4,279,437; and U.S. Pat. No. Des. 263,512.

While these devices fulfill their respective, particular objectives and requirements, the aforementioned patents do not disclose a new pet refuse collecting system. The inventive device includes a housing for collecting and storing the pet refuse. An end of the housing includes an opening extending into an interior of the housing. An end of a handle is mounted on the housing for transporting the housing. A gathering assembly is provided for facilitating movement of pet refuse into the interior of the housing.

In these respects, the pet refuse collecting system according to the present invention substantially departs from the conventional concepts and designs of the prior art, and in so doing provides an apparatus primarily developed for the purpose of more easily collecting pet refuse.

SUMMARY OF THE INVENTION

In view of the foregoing disadvantages inherent in the known types of pet refuse scooping devices now present in the prior art, the present invention provides a new pet refuse collecting system construction wherein the same can be utilized for more easily collecting pet refuse.

The general purpose of the present invention, which will be described subsequently in greater detail, is to provide a new pet refuse collecting system apparatus and method which has many of the advantages of the pet refuse scooping devices mentioned heretofore and many novel features that result in a new pet refuse collecting system which is not anticipated, rendered obvious, suggested, or even implied by any of the prior art pet refuse scooping devices, either alone or in any combination thereof.

To attain this, the present invention generally comprises a housing for collecting and storing the pet refuse. An end of the housing includes an opening extending into an interior of the housing. An end of a handle is mounted on the housing for transporting the housing. A gathering assembly is provided for facilitating movement of pet refuse into the interior of the housing.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for transporting out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new pet refuse collecting system apparatus and method which has many of the advantages of the pet refuse scooping devices mentioned heretofore and many novel features that result in a new pet refuse collecting system which is not anticipated, rendered obvious, suggested, or even implied by any of the prior art pet refuse scooping devices, either alone or in any combination thereof.

It is another object of the present invention to provide a new pet refuse collecting system which may be easily and efficiently manufactured and marketed.

It is a further object of the present invention to provide a new pet refuse collecting system which is of a durable and reliable construction.

An even further object of the present invention is to provide a new pet refuse collecting system which is susceptible of a low cost of manufacture with regard to both materials and labor, and which accordingly is then susceptible of low prices of sale to the consuming public, thereby making such pet refuse collecting system economically available to the buying public.

Still yet another object of the present invention is to provide a new pet refuse collecting system which provides in the apparatuses and methods of the prior art some of the advantages thereof, while simultaneously overcoming some of the disadvantages normally associated therewith.

Still another object of the present invention is to provide a new pet refuse collecting system for more easily collecting pet refuse.

Yet another object of the present invention is to provide a new pet refuse collecting system which includes a housing for collecting and storing the pet refuse. An end of the housing includes an opening extending into an interior of the housing. An end of a handle is mounted on the housing for transporting the housing. A gathering assembly is provided for facilitating movement of pet refuse into the interior of the housing.

Still yet another object of the present invention is to provide a new pet refuse collecting system that allows a user to more easily collect pet refuse without having to bend over and strain their back. Additionally, the present invention allows a user to collect the pet refuse without having to touch the pet refuse with their hands.

Even still another object of the present invention is to provide a new pet refuse collecting system that, unlike the prior art, has a housing that has an hour-glass shape to ensure that the pet refuse remains in the housing after being scooped up by the user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
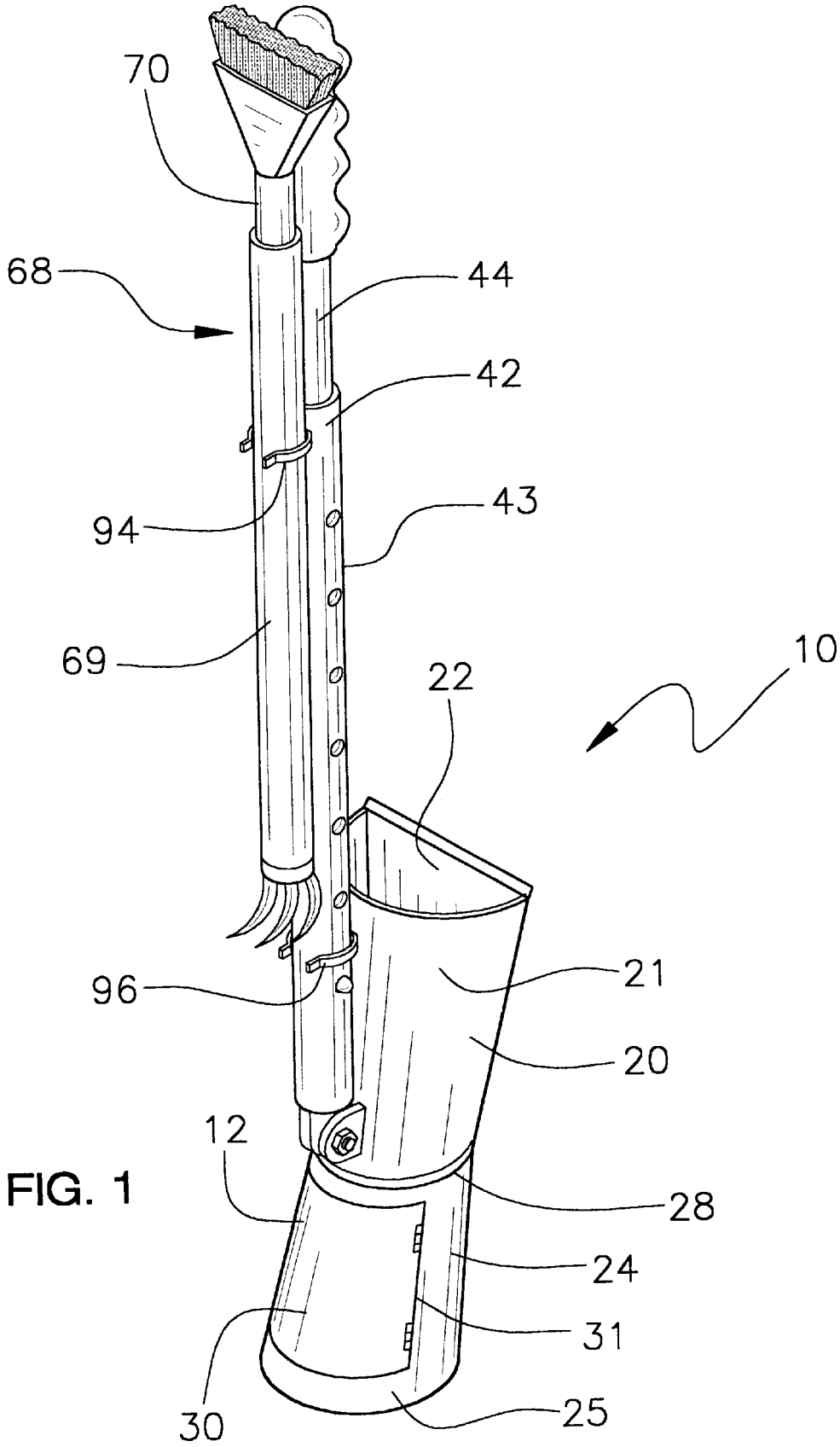
FIG. 1 is a schematic perspective view of a new pet refuse collecting system according to the present invention.
Figure 2:
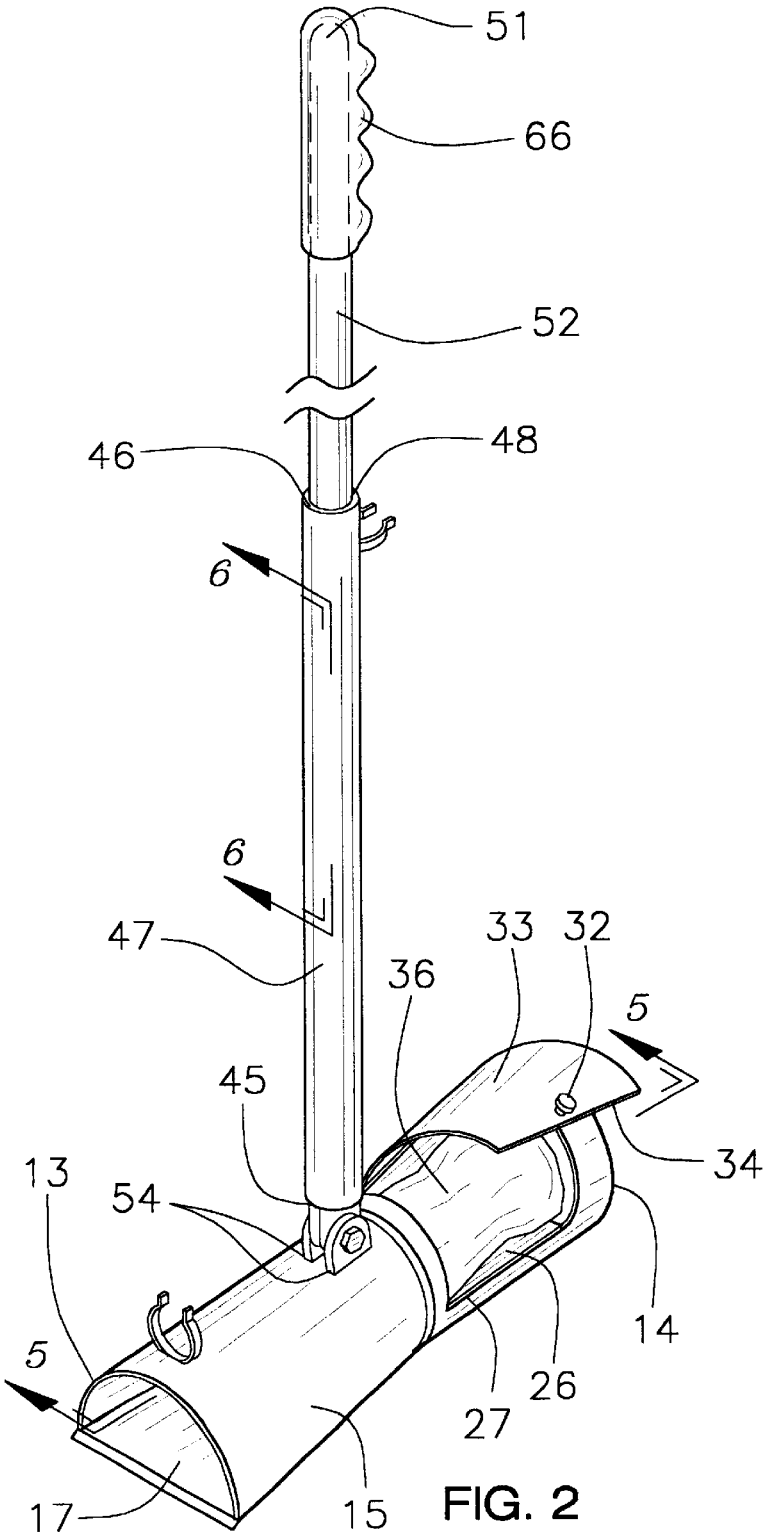
FIG. 2 is a schematic perspective view of the present invention.
Figure 3:
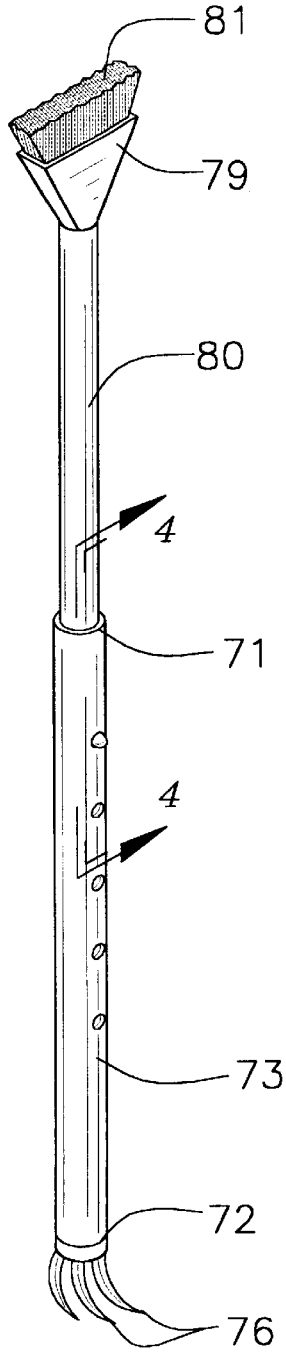
FIG. 3 is a schematic perspective view of the present invention showing a gathering assembly.
Figure 4:
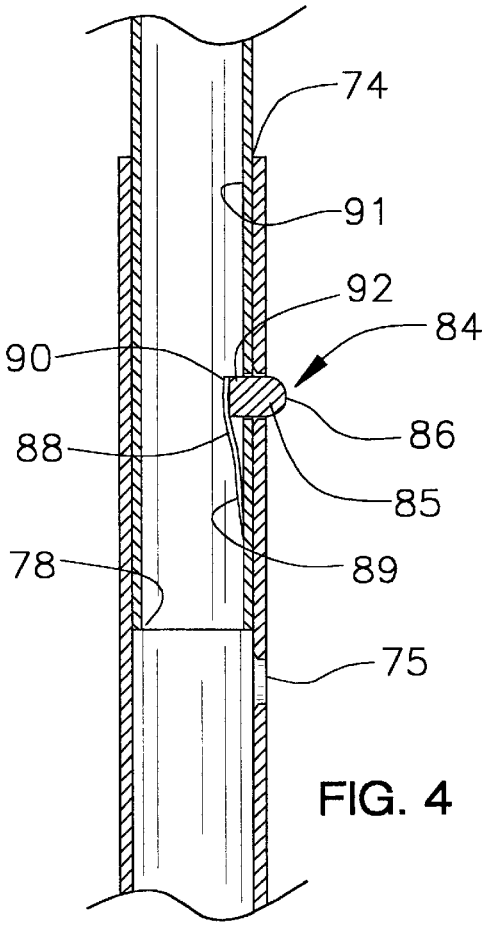
FIG. 4 is a schematic cross-sectional view of the present invention taken along line 4—4 of FIG. 3.
Figure 6:
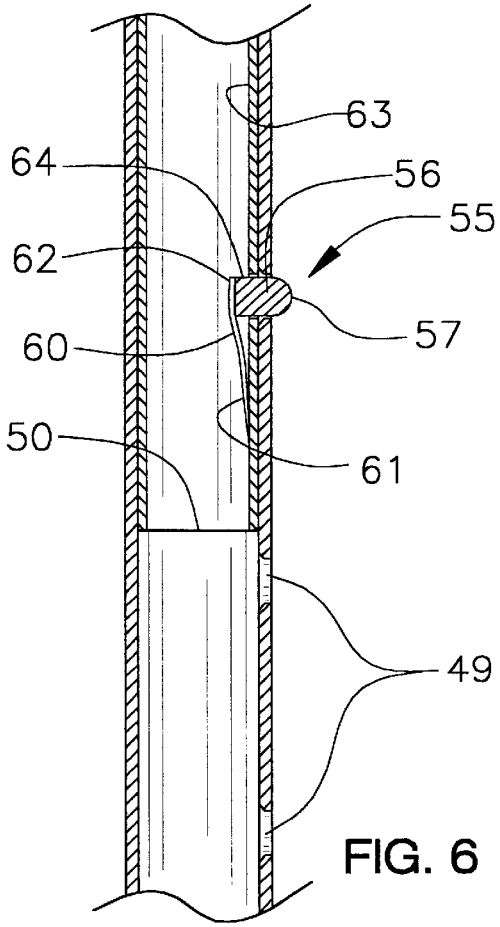
FIG. 6 is a schematic cross-sectional view of the present invention taken along line 6—6 of FIG. 2.
Figure 5:
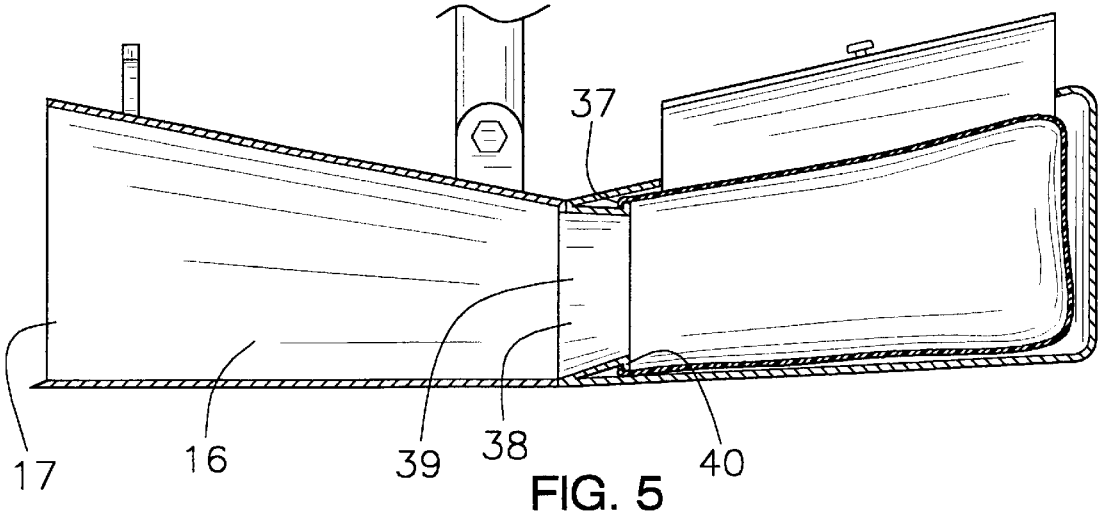
FIG. 5 is a schematic cross-sectional view of the present invention taken along line 5—5 of FIG. 2.

With reference now to the drawings, and in particular to FIGS. 1 through 6 thereof, a new pet refuse collecting system embodying the principles and concepts of the present invention and generally designated by the reference numeral 10 will be described.

As best illustrated in FIGS. 1 through 6, the pet refuse collecting system 10 generally comprises a housing 12 for collecting and storing the pet refuse. The housing 12 includes a first end 13, a second end 14 and a peripheral wall 15 extending between the first 13 and second 14 ends of the housing 12 defining an interior 16 of the housing 12. The first end 13 of the housing 12 includes an opening 17 for providing access to the interior 16 of the housing 12.

The housing 12 may comprise a scoop portion 20 for scooping the pet refuse from a surface such as, for example, grass or sidewalks. The scoop portion 20 preferably includes a rounded upper wall 21 and a flat lower wall 22. The opening 17 in the housing 12 extends into the scoop portion 20 of the housing 12 for inserting the pet refuse into the interior 16 of the housing 12. The flat lower wall 22 of the scoop portion 20 may have a lip for facilitating the pet refuse entering the scoop portion 20 of the housing 12.

The housing 12 may also comprise a storage portion 24 for storing the pet refuse after it passes through the opening 17 and passes through the scoop portion 20 of the housing 12. The storage portion 24 may include a rounded upper wall 25 and a flat lower wall 26. The storage portion 24 may include an aperture 27 extending through the rounded upper wall 25 of the storage portion 24 for providing access to the interior 16 of the housing 12 and facilitating removal of the pet refuse from the storage portion 24 of the housing 12. The aperture 27 may be positioned generally between a central portion 28 of the housing and the second end 14 of the housing 12.

In one embodiment of the present invention, a cross-sectional area of the housing 12 tapers from each of the ends 13 and 14 of the housing 12 toward the central portion 28 of the housing 12 for preventing pet refuse from escaping from the interior 16 of the housing 12 after it passes through the scoop portion 20 and enters the storage portion 24 of the housing 12. The tapering of the housing 12 gives the housing 12 a generally hour-glass shape, however, other shapes may employed.

The housing 12 may measure approximately twelve and one-half inches in length. The housing 12 may also have a width measuring approximately seven inches at each of the ends 13 and 14 of the housing 12. The housing 12 may comprise a substantially rigid material such as, for example, a plastic or metal material.

A door 30 may be provided for selectively closing the aperture 27 in the storage portion 24 of the housing 12. An edge 31 of the door 30 is preferably pivotally coupled to the rounded upper wall 25 of the storage portion 24. The door 30 preferably includes a generally arcuate shape to match the rounded upper wall 25 of the storage portion 24 of the housing 12.

A knob 32 may be mounted on the door 30 for opening and closing the door 30 for removal of the pet refuse from the storage portion 24 of the housing 12. The knob 32 may be mounted on an outer surface 33 of the door 30. The knob 32 may be positioned generally adjacent to an end 34 of the door 30.

A bag 36 may be provided for collecting the pet refuse passing through the scoop portion 20 and entering the storage portion 24 of the housing 12. The bag 36 is preferably removably mounted in the interior 16 of the housing 12. An edge 37 of the bag 36 defines an opening for providing access to an interior of the bag 36. The bag 36 may comprise a flexible material such as, for example, a plastic or paper material.

An annular collar 38 may be provided for securing the bag 36 in the interior 16 of the housing 12. The annular collar 38 is preferably mounted in the interior 16 of the housing 12 and preferably extends from the central portion 28 of the housing 12 into the storage portion 24 of the housing 12. The annular collar 38 includes a hole 39 extending therethrough that is in registration with the opening 17 in the first end 13 of the housing 12. The annular collar 38 may include an annular lip 40 formed thereon. The edge 37 of the bag 30 may be removably mounted to the annular lip 40 of the annular collar 38. In one embodiment of the present invention, the pet refuse passes through the hole 39 in the annular collar 38 after passing through the scoop portion 20 of the housing 12.

A handle 42 is provided for transporting the housing 12. The handle 42 is pivotally mounted on the housing 12 between a stored position and a scooping position. In one embodiment of the present invention, the stored position is characterized by a longitudinal axis of the handle 42 being orientated generally parallel to a longitudinal axis of the housing 12. The scooping position is characterized by the longitudinal axis of the handle 42 being orientated generally perpendicular to the longitudinal axis of the housing 12. The handle 42 may include a first segment 43 and a second segment 44. The second segment 44 may selectively telescope with respect to the first segment 43.

In one embodiment of the present invention, the first segment 43 has a first end 45, a second end 46 and a peripheral wall 47 extending therebetween. The first end 45 may be pivotally mounted on the peripheral wall 15 of the housing 12 and may preferably be mounted on the rounded upper wall 21 of the scoop portion 20 of the housing 12. The second end 46 of the. first segment 43 may include an opening 48 extending into the first segment 43. The peripheral wall 47 of the first segment 43 may include a plurality of spaced holes 49 extending through the peripheral wall 47 of the first segment 43.

In one embodiment of the present invention, the second segment 44 has a first end 50, a second end 51 and a peripheral wall 52. The first end 50 of the second segment 44 is slidably positioned in the, opening 48 in the second end 46 of the first segment 43.

The handle 42 may measure approximately between two feet and three feet in length depending upon how far the second segment 44 is telescoping into the first segment 43. The handle 42 may, comprise a substantially rigid material such as, for example, a plastic or metal material.

A pair of spaced ear members 54 may be mounted on the peripheral wall 15 of the housing 12 for pivotally coupling the first end 45 of the first segment 43 to the housing 12. The pair of spaced ear members 54 may be mounted on the rounded upper wall 25 of the scoop portion 20 and may be positioned generally adjacent to the central portion 28 of the housing 12.

A locking assembly 55 may be provided for selectively locking the second segment 44 in a fixed position with respect to the first segment 43. The locking assembly 55 may include a button 56 that is depressibly mounted on the peripheral wall 52 of the second segment 44. The button 56 may include a protruding condition and a retracted condition. In one embodiment of the present invention, the protruding condition is characterized by a first end 57 of the button 56 extending through one of the holes 49 in the peripheral wall 47 of the first segment 43. The retracted condition is characterized by the first end 57 of the button 56 not extending through one of the holes in the peripheral wall of the first segment.

A biasing member 60 may be provided for biasing the button 56 into the protruding condition. The biasing member 60 may include a first end 61 and a second end 62. The first end 61 of the biasing member 60 may be mounted on an inner surface 63 of the peripheral wall 47 of the second segment 44. The second end 62 of the biasing member 60 may be mounted on a second end 64 of the button 56. In one embodiment of the present invention, the first segment 43 and the second segment 44 may telescope when the button 56 is in the retracted condition.

A grip 66 may be provided for being gripped by a hand of a user. The grip 66 may be mounted on the second segment 44 and positioned generally adjacent to the second end 51 of the second segment 44.

A gathering assembly 68 is provided for facilitating movement of pet refuse into the housing 12. The gathering assembly 68 may include a rake portion 69 and a brush portion 70. The brush portion 70 may selectively telescope with respect to the rake portion 69. In one embodiment of the present invention, the rake portion has a first end 71, a second end 72 and a peripheral wall 73 extending therebetween. The first end 71 of the rake portion 69 may have a channel 74 extending therein. The peripheral wall 73 of the rake portion 69 may include a plurality of holes 75 extending through the peripheral wall 73 of the rake portion 69. A plurality of arcuate members 76 may be formed on the second end 72 of the rake portion 69 of the gathering assembly 68 for gathering pet refuse. Each of the arcuate members 76 may have a pointed end for more easily facilitating movement of the pet refuse into the housing 12.

In one embodiment of the present invention, the brush portion 70 may have a first end 78, a second end 79 and a peripheral wall 80 extending therebetween. The first end 78 of the brush portion 70 may be slidably positioned in the channel 74 in the first end 71 of the rake portion 69. A plurality of bristles 81 may be mounted on the second end 79 of the brush portion 70 of the gathering assembly 68 for brushing pet refuse into the opening 17 in the housing 12. Each of the bristles 81 may comprise a generally flexible material such as, for example, a plastic material.

The gathering assembly 68 may measure between two and one-half feet and three feet in length depending upon how far the brush portion 70 is telescoping into the rake portion 69 of the gathering assembly 68. The gathering assembly 68 may comprise a substantially rigid material such as, for example, a plastic or a metal material.

A securing assembly 84 may be provided for securely fixing the brush portion 70 with respect to the rake portion 69 of the gathering assembly 68. The securing assembly 84 may include a pin 85 that may be mounted on the peripheral wall 80 of the brush portion 70. The pin 85 includes a protruding condition and a retracted condition. In one embodiment of the present invention, the protruding condition is characterized by a first end 86 of the pin 85 extending through one of the holes 75 in the peripheral wall 73 of the rake portion 69. The retracted condition is characterized by the first end 86 of the pin 85 not extending through one of the holes 75 in the peripheral wall 73 of the rake portion 69.

A spring member 88 may be provided for biasing the pin 85 into the protruding condition. The spring member 88 may include a first end 89 and a second end 90. The first end 89 of the spring member 88 may be mounted on an inner surface 91 of the peripheral wall 73 of the brush portion 70. The second end 90 of the spring member 88 may be mounted on a second end 92 of the pin 85. In one embodiment of the present invention, the rake portion 69 and the brush portion 70 may telescope when the pin 85 is in the retracted condition.

A clamp 94 may be provided for removably clamping the gathering assembly 68 to the handle 42. The clamp 94 may be mounted on the peripheral wall 47 of the first segment 43 and may be positioned generally adjacent to the first end 46 of the first segment 43. The clamp 94 may comprise a generally arcuate member that includes a break therein for removably receiving the gathering assembly 68.

A clip 96 may be provided for removably clipping the handle 42 in the stored position. The clip 96 may be mounted on the rounded upper wall 21 of the scoop portion 20 of the housing 12 and may be positioned generally adjacent to the first end 13 of the housing 12. The clip 96 may comprise a generally arcuate member that includes a break therein for removably receiving handle 42.

In use, second end 14 of the housing is pressed against a surface to move the housing 12 from the stored position to the scooping position. A user removes the gathering assembly 68 from the clamp 94 and may use the rake portion 69 to gather the pet refuse to a location near the opening 17 of the housing 12. The user may then use the brush portion 70 of the gathering assembly 68 to brush the pet refuse into the interior 16 of the housing 12. The user may then remove the bag 36 from the interior 16 of the housing 12 and dispose of it accordingly.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pet refuse collecting system for collecting pet refuse from a surface, said system comprising:

a housing for collecting and storing the pet refuse, an end of said housing having an opening extending into an interior of said housing;

a handle for transporting said housing, said handle being mounted on an end of said housing;

a gathering assembly for facilitating movement of pet refuse into said interior of said housing; and wherein said gathering assembly includes a rake portion and a brush portion, each of said portions having a first end, a second end and peripheral wall extending therebetween, said brush portion selectively telescoping with respect to said rake portion, said first end of said rake portion having a channel extending therein for slidably receiving said first end of said brush portion.

2. The pet refuse collecting system of claim 1, wherein said housing comprises a scoop portion and a storage portion.

3. The pet refuse collecting system of claim 2, additionally including a door being mounted on an upper wall of said storage portion of said housing for selectively closing an aperture in said upper wall of said storage portion of said housing.

4. The pet refuse collecting system of claim 2, wherein a cross-sectional area of said housing tapers from each of a pair of ends of said scoop and storage portions toward a central portion of said housing.

5. The pet refuse collecting system of claim 1, additionally including a bag for collecting pet refuse passing through said opening in said housing, said bag being removably mounted in said interior of said housing.

6. The pet refuse collecting system of claim 5, additionally including an annular collar being mounted in said interior of said housing for securing said bag in said interior of said housing.

7. The pet refuse collecting system of claim 1, wherein said handle is pivotally mounted on said housing between a stored position and a scooping position, wherein said stored position is characterized by a longitudinal axis of said handle being orientated generally parallel to a longitudinal axis of said housing, wherein said scooping position is characterized by said longitudinal axis of said handle being orientated generally perpendicular to said longitudinal axis of said housing.

8. The pet refuse collecting system of claims 7, wherein said handle has a first segment and a second segment, each of said segments having a first end, a second end and a peripheral wall extending therebetween, said second segment selectively telescoping with respect to said first segment, said first end of said second segment being slidably positioned in an opening extending into said second end of said first segment.

9. The pet refuse collecting system of claim 8,additionally including a locking assembly for selectively locking said second segment in a fixed position with respect to said first segment, said locking assembly including a button being depressibly mounted on said second segment and extendible through a hole in said peripheral wall of said first segment.

10. The pet refuse collecting system of claim 9, wherein said button has a protruding condition and a retracted condition, wherein said protruding condition is characterized by a first end of said button extending through one of a plurality of holes extending through said peripheral wall of said first segment, wherein said retracted condition is characterized by said first end of said button not extending through one of said holes in said peripheral wall of said first segment.

11. The pet refuse collecting system of claim 10, additionally including a biasing member for biasing said button into said protruding condition, a first end of said biasing member being mounted on an inner surface of said peripheral wall of said second segment, a second end of said biasing member being mounted on a second end of said button, wherein said first segment and said second segment are telescopable when said button is in said retracted condition.

12. The pet refuse collecting system of claim 1, wherein said rake portion has a plurality of arcuate members formed on said second end of said rake portion for gathering pet refuse, a plurality of bristles being mounted on said second end of said brush portion for brushing pet refuse into said opening in said housing.

13. The pet refuse collecting system of claim 1, additionally including a securing assembly being mounted on said brush portion for securely fixing said brush portion with respect to said rake portion of said gathering assembly.

14. The pet refuse collecting system of claim 13, wherein said securing assembly includes a pin being depressibly mounted on said peripheral wall of said brush portion, a spring member being mounted on said peripheral wall of said brush portion, an end of said spring member being mounted on an end of said pin.

15. The pet refuse collecting system of claim 14, wherein said pin has a protruding condition and a retracted condition, wherein said protruding condition is characterized by a an end of said pin extending through one of a plurality of holes in said peripheral wall of said rake portion, wherein said retracted condition is characterized by said end of said pin not extending through one of said holes in said peripheral wall of said rake portion, said spring member biasing said pin into said protruding condition.

16. The pet refuse collecting system of claim 1, additionally including a clamp for removably clamping said gathering assembly to said handle, said clamp being mounted on said handle, said clamp comprising a generally arcuate member having a break therein for removably receiving said gathering assembly.

17. A pet refuse collecting system for collecting pet refuse from a surface, said system comprising:

a housing for collecting and storing the pet refuse, an end of said housing having an opening extending into an interior of said housing;

a handle for transporting said housing, said handle being mounted on an end of said housing;

a gathering assembly for facilitating movement of pet refuse into said interior of said housing;

a bag for collecting pet refuse passing through said opening in said housing, said bag being removably mounted in said interior of said housing;

an annular collar being mounted in said interior of said housing for securing said bag in said interior of said housing; and wherein said annular collar has an annular lip formed thereon for removably securing said bag to said annular collar.

18. A pet refuse collecting system for collecting pet refuse from a surface, said system comprising:

a housing for collecting and storing the pet refuse, an end of said housing having an opening extending into an interior of said housing;

a handle for transporting said housing, said handle being mounted on an end of said housing;

a gathering assembly for facilitating movement of pet refuse into said interior of said housing; and a clip being mounted on said peripheral wall of said housing for removably clipping said handle in a stored position, said clip comprising a generally arcuate member having a break therein for removably receiving said handle.

* * * * *